United States Patent [19]

Boucher

[11] 4,190,283

[45] Feb. 26, 1980

[54] FOLDABLE PLAY GYM

[75] Inventor: Raymond W. Boucher, Dotham, Ala.

[73] Assignee: Hedstrom Co., Bedford, Pa.

[21] Appl. No.: 908,332

[22] Filed: May 22, 1978

Related U.S. Application Data

[63] Continuation of Ser. No. 811,176, Jun. 29, 1977, abandoned, which is a continuation-in-part of Ser. No. 665,539, Mar. 10, 1976, abandoned.

[51] Int. Cl.[2] ..... A47C 15/00

[52] U.S. Cl. ..... 297/77; 272/113; 403/65; 403/170; 272/85; 297/245

[58] Field of Search ..... 272/62, 85, 63, 111, 272/110, 113, 109, 102, 61; 182/155; 403/65, 64, 150, 172, 170, 176, 171, 62; 248/163, 165, 461; 297/245, 273, 232

[56] References Cited

U.S. PATENT DOCUMENTS

| | | | |
|---|---|---|---|
| 1,224,893 | 5/1917 | Beckwith | 182/155 |
| 1,846,144 | 2/1932 | Risbridger et al. | 182/155 |
| 3,144,914 | 8/1964 | Tjosvoll | 182/155 |
| 3,483,999 | 12/1969 | Barrett | 182/155 |
| 3,624,762 | 11/1971 | Hankins | 182/155 |

*Primary Examiner*—Richard C. Pinkham
*Assistant Examiner*—William R. Browne
*Attorney, Agent, or Firm*—Cesari and McKenna

[57] ABSTRACT

A play gym comprising a horizontal bar from which swings and other rides are suspended is supported at its opposite ends by legs. Special pivot joints connect the pairs of legs to the horizontal bar which permit each pair of legs to be folded together and against the horizontal bar so that the gym can assume a stick-like configuration. When the legs are unfolded to support the horizontal bar, parts of the pivot joints engage the ends of the horizontal bar thereby preventing end-wise movement and racking of the play gym. Provision is also made for substituting one pair of legs by a horizontal pivot arrangement which can be secured to a vertical support so that the gym can be used in a small area and be folded out of the way against the support when not in use.

12 Claims, 17 Drawing Figures

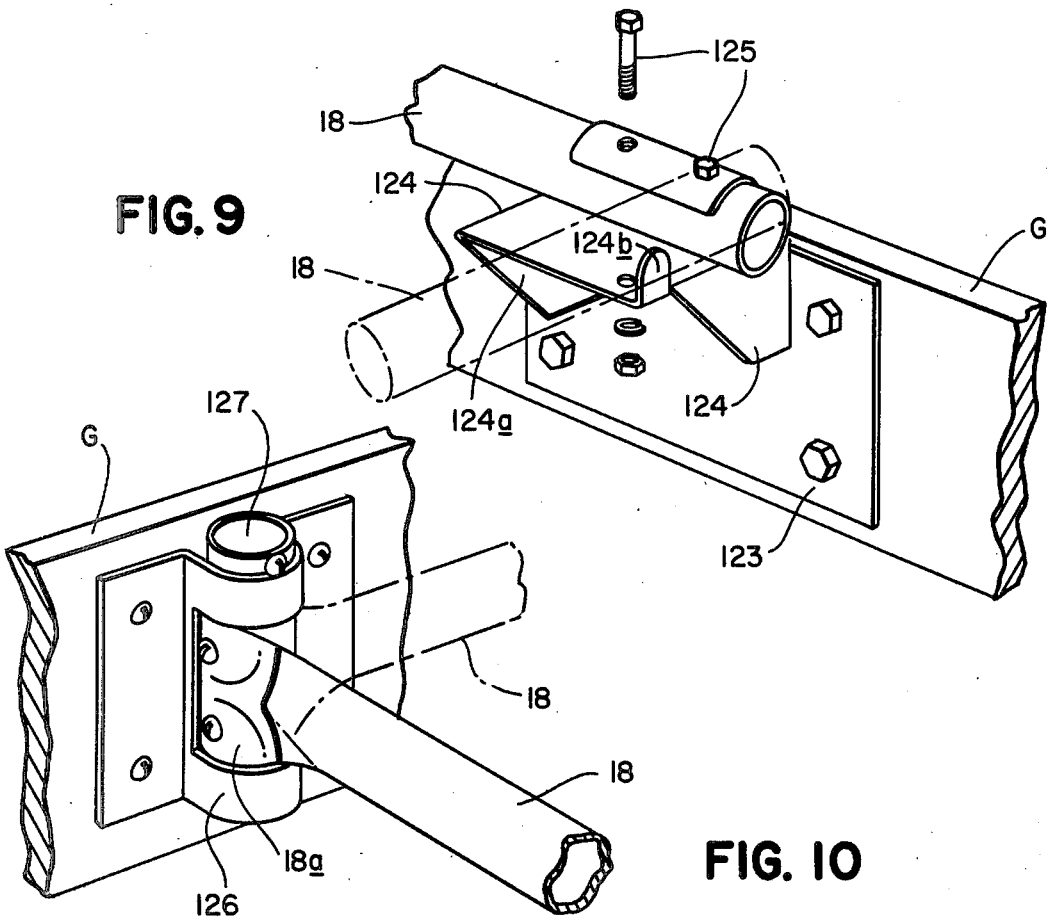
FIG. 9
FIG. 10
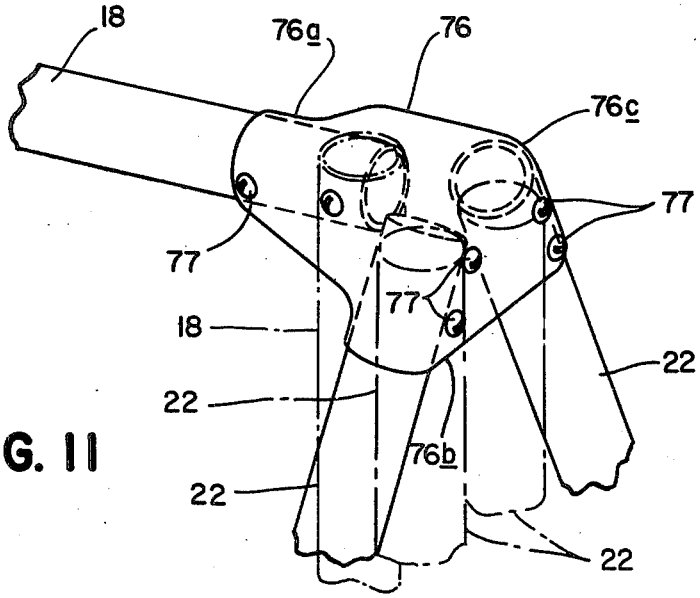
FIG. 11

FOLDABLE PLAY GYM

RELATED APPLICATION

This is a continuation of application Ser. No. 811,176 filed June 29, 1977, now abandoned which is a continuation in part of application Ser. No. 655,539, filed Mar. 10, 1976, now abandoned, entitled FOLDABLE PLAY GYM.

BACKGROUND OF THE INVENTION

This invention relates to a play gym, it relates more particularly to an outdoor play gym of the type which includes swings and other kinetic play devices.

Play gyms have, of course, have been available for many years. Invariably they take the form of one or more horizontal bars from which are suspended swings and the like, supported at its opposite ends by legs arranged as A-frames or T-frames. Invariably also the upper ends of the legs are connected to the ends of the horizntal bars by rigid socket-type joints which envelop the ends of the bars to provide rigid connections between the legs and the bars. If the play gym is unusually long, a third set of supportive legs is often situated at the middle of the horizontal bars.

Prior play gyms are sold in a knocked down condition with the horizontal bar and various legs, brackets, bolts, nuts, etc. all being more or less loose in the shipping carton. Consequently, all the components of the gym must be assembled by the ultimate purchaser. This is usually a time consuming task for the average parent. A typical prior play gym requires installation of over two dozen bolts to assemble the gym frame alone. Additional nut and bolt connections are required to assemble the individual gym rides.

Furthermore, once the gym is assembled and exposed to the elements, it is extremely difficult to knock down the play gym for storage or to move it from one location to another because the individual bolts become rusted and bent. In fact, in many cases the only feasible way to remove them is with a hacksaw.

Because it is so difficult to disassemble the average play gym, few people bother to store the gym in the winter months when it is not in use. Consequently the prior play units do not last as long as they should. Furthermore, since there are so many loose parts associated with the conventional units, even when they are disassembled, braces, bolts, nuts and other parts become misplaced or lost. Consequently when the time comes to reassemble the gym, new parts have to be purchased.

The up-shot of all these problems is that once the usual play gym is assembled, it tends to remain in the same location for its entire life. It is not moved when the family goes on vacation to a summer home and in many cases it does not even accompany the family upon a permanent change of residence.

Another problem with conventional play gyms is that they take up a considerable amount of yard space. Thus where yard space is quite limited, say, in the city, an unused play gym restricts the use of the yard for other activities.

SUMMARY OF THE INVENTION

Accordingly the present invention aims to provide a play gym that can be folded into a stick-like package so that it can readily be transported or stored in a minimum amount of space.

Another object of the invention is to provide a play gym, most of whose parts are interconnected at the factory, leaving only a few bolts to be installed by the purchaser.

Yet another object of the invention is to provide a play gym which can be erected in a very short time.

Still another object of the invention is to provide a play gym that can be folded up out of the way when not in use.

Still another object of the invention is to provide a foldable play gym which can be taken down quickly as compared with prior compatible equipment.

A further object of the invention is to provide play gym rides which are also foldable so that they occupy a minimum amount of storage space.

Still another object of the invention is to provide an outdoor play gym which is foldable yet quite sturdy when erected in its upright position.

Other objects will, in part, be obvious and will, in part, appear hereinafter.

The invention accordingly comprises features of construction, combination of elements, and arrangement of parts which will be exemplified in the following detailed description, and the scope of the invention will be indicated in the claims.

In general, the present play gym includes one or more horizontal bars from which are suspended swings, including foldable swings which will be described later. In one embodiment, the bar is supported above the ground by pairs of legs arranged as A-frames connected at opposite ends of the bar and extending down to the ground. Each pair of legs is joined to the bar by a special three-axis pivot joint which permits each pair of legs to fold together and also against the horizontal bar so that the gym can be collapsed into a stick-like form, which makes it quite easy to transport and store the gym in a minimum amount of space.

Each pivot joint includes a pair of relatively large-area clam shells which clamp against opposite sides of the horizontal bar when the legs are in their upright, spread-apart condition. Consequently each joint prevents end-wise movement and racking of the play gym frame when children are using it.

In another embodiment, two horizontal bars are supported side by side by pairs of vertical legs connected to the ends of the bars by pivot joints. These joints also permit the legs to be folded against the horizontal bars for efficient storage.

All of the major components of the play gym frames are interconnected at the factory by rivets or the like. Resultantly, in order to erect the gym, the purchaser merely has to unfold the legs and install as few as two bolts in order to secure the gym in its upright position. Consequently the gym can be erected in a very short time with minimum effort.

By the same token, if it becomes necessary to take down the play gym for transportation of storage, only these same two bolts need be removed to permit the gym frame to be folded up into its stick-like form.

In the event that auxiliary legs are needed to support the middle of a particularly long horizontal bar, these also are easily removable from the bar and foldable so that they also can repose stick-like adjacent the horizontal bar.

As will be described later, provision is also made for supporting the horizontal bar at one end by means of a horizontal pivot joint attachment to a vertical surface so that the play gym can be folded up out of the way against that surface when not in use. This permits the area formerly occupied by the gym to be used for other purposes.

All of these features make the subject play gym a particularly desirable piece of outdoor play equipment which should have a long useful life and provide minimum inconvenience to the owner.

BRIEF DESCRIPTION OF THE DRAWINGS

For a fuller understanding of the nature and objects of the invention, reference should be had to the following detailed description taken in connection with the accompanying drawings, in which:

FIG. 9 is a view similar to FIG. 6 showing a modified pivot structure for use in the FIG. 5 swing;

FIG. 10 is a similar view of another pivot embodiment for the FIG. 5 swing;

FIG. 11 is a similar view of a modified pivot structure for the FIG. 1 swing;

DESCRIPTION OF THE PREFERRED EMBODIMENTS

Figure 1:
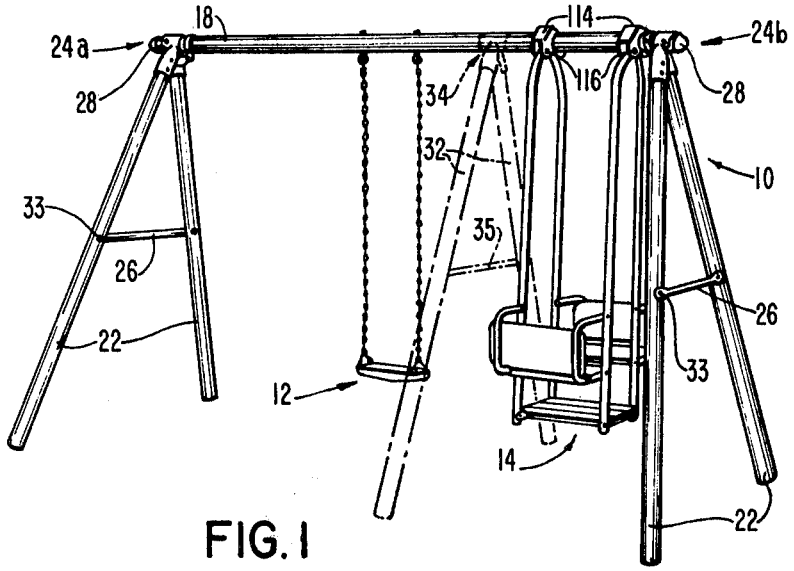
FIG. 1 is a perspective view of a play gym made in accordance with this invention.

Referring now to FIG. 1 of the drawings, one embodiment of the subject play gym includes a frame shown generally at 10 which supports a pair of swings indicated generally at 12 and 14. The frame includes a horizontal bar 18 which is supported at its ends by pairs of legs 22 arranged as A-frames. Each A-frame is connected at its apex to the horizontal bar by means of three-axis pivot joints 24*a* and 24*b* to be described in detail later. The legs 22 comprising each A-frame are held in spaced-apart relation by a horizontal brace 26 installed midway between the horizontal bar 18 and the ground. Plastic end caps 28 close the opposite ends of bar 18.

In the event that the bar 18 is unusually long, an auxiliary pair of legs 32 in the form of an A-frame is installed near the middle of the bar. Those legs are connected to the bar by an integral clamp shown generally at 34 and the two legs are held apart by a horizontal brace 35, midway between the bar 18 and the ground, all is shown in dotted lines in FIG. 1.

Figure 3:
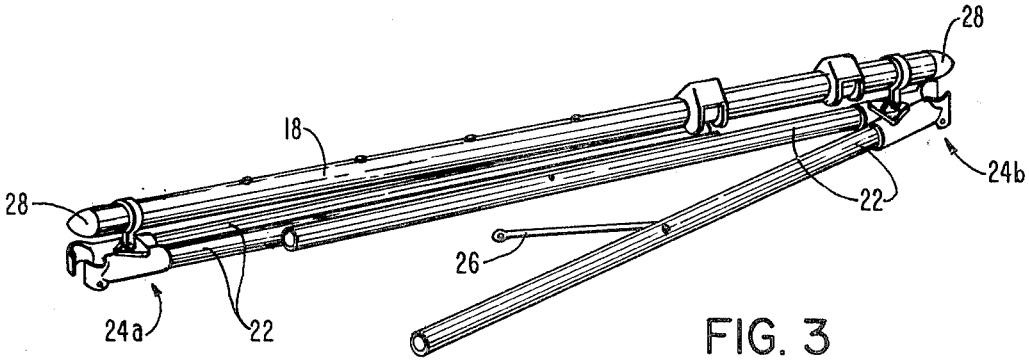
FIG. 3 is a perspective view showing the FIG. 1 play gym frame folded into its stick-like form.

After removing the swings 12 and 14, the gym frame 10 can be folded easily from its fully erected condition illustrated in FIG. 1 to a folded condition shown in FIG. 3 wherein it reposes in stick form. For this, it is only necessary to remove a bolt 33 securing one end of each brace 26 to the adjacent leg 22. With that end released, each brace 26 can be folded down flush against the leg 22 to which its other end is pivotally attached. The three-axis pivot joints 24*a* and 24*b* then permit each pair of legs 22 to be folded together and also allow both pairs of legs to be folded against the horizontal bar 18. All these frame parts are interconnected at the factory using rivets, bolts or other comparable securements and they remain interconnected even when the play gym is fully folded. Consequently the chances are small of major components of the gym becoming misplaced or lost.

Figure 2A:
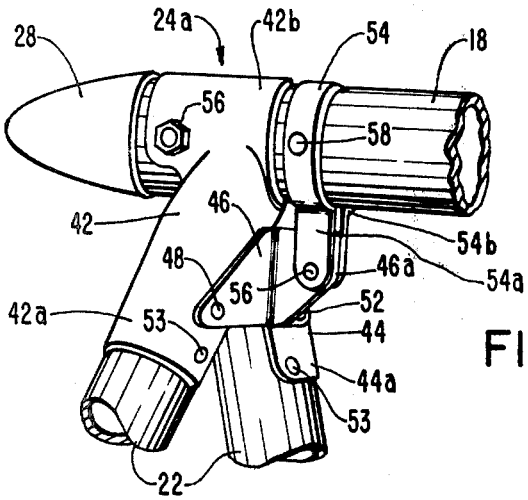
FIGS. 2A to 2C are fragmentary perspective views showing the three-axis pivot joint used in the FIG. 1 gym in its unfolded, partially folded and fully folded positions.
Figure 2B:
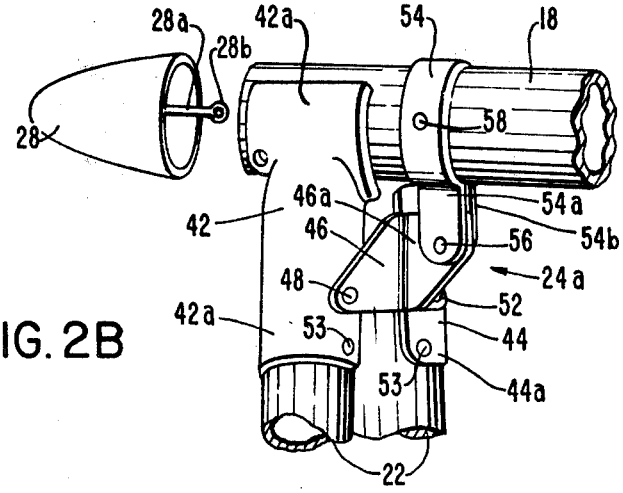
Figure 2C:
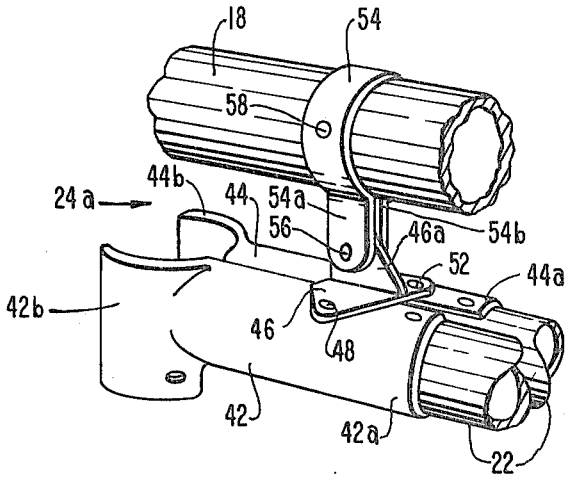

Referring now to FIGS. 2A to 2C, three-axis pivot joints 24*a* and 24*b* are mirror images of one another. Consequently we will describe only the former joint in detail. It comprises a pair of mirror image sections 42 and 44, each of which consists of a single metal stamping. Section 42 is formed with a socket 42*a* which engages around the upper end of a leg 22, extending, say, three-fourths of the way around the leg. Section 42 also includes an arcuate shell 42*b* integral with the upper end of 42*a* whose axis is generally perpendicular to that of socket 42*a*. The diameter of shell 42*b* is essentially the same as that of bar 18 so that the shell can engage around one side of the bar as best seen in FIG. 2A. The opposite joint section 44 includes a comparable socket 44*a* for receiving the end of leg 22 and a integral arcuate shell 44*b* for engaging around the opposite side of bar 18 (FIG. 2C).

The two sections 42 and 44 are pivotally connected together by a trapezoidal bracket 46 positioned at one side of sockets 42*a* and 44*a* directly below bar 18. One end of bracket 46 is pivotally connected to section 42 by means of a rivet 48 or other comparable securement extending through the bracket, through socket 42*a* and through the leg 22 received in that shell. A similar rivet 52 extends through the opposite end of bracket 46 through socket 44*a* and the leg 22 in that socket. Additional rivets 53 are driven through the sockets 42*a*, 44*a* and the underlying legs 22 to securely anchor the legs in the sockets. Bracket 46 also a prominent ear 46*a* extending out parallel to and below, bar 18.

A metal strap 54 is looped around bar 18 adjacent joint sections 42 and 44. The two strap ends 54*a* and 54*b* extend down on opposite sides of ear 46*a* to which they are pivotally connected by means of a rivet 56. Additional rivets 58 extend through the strap into opposite sides of bar 28 to permanently secure the strap to the bar. The joint sections 42 and 44 are thus hinged together and also to bar 18 so as to form the strong three-axis pivot joint that rigidly supports the gym, yet permits the legs 22 to be folded together and also flush against bar 18 when it is desired to store the play gym.

As shown in FIG. 2A, when the legs 22 are spread apart and stand upright in their normal position, the arcuate sections 42*b* and 44*b* form clam shells which clamp against opposite sides of the horizontal bar 18. Any weight on the bar 28 tends to clamp the shells even more tightly against the bar so that a firm, rigid connection is maintained between legs 22 and the bar 28. As a further safety precaution, however, the customer may insert a bolt 56 through in-line openings provided in shells 42*b* and 44*b* and in the opposite walls of bar 18 and secure it there with a suitable nut (not shown). The bolt may also help to retain the end-cap 28 in place. For this, the end-cap is provided within an internal extension 28*a* terminating in an eye 28*b* through which the bolts 56 extends. See FIG. 2B. Alternatively, the bolt 56 may be inserted through pairs of aligned ears in the top edges of shells 42*b* and 44*b*. One such ear is shown in dotted lines at 57 in FIG. 2A. Thus even with this added safety feature only four customer-installed bolts are required in order to erect the gym frame 10.

As shown in FIG. 2B, when the legs 22 are folded together to store the gym frame 10, the clam shells 42*b* and 44*b* are spread apart thereby releasing bar 18. Whereupon the legs can be swung about the pivot at rivet 56 to bring the legs 22 flush against bar 28 as shown in FIG. 2C. The opposite end of the play gym has comparable structural elements permitting the other pair of legs 22 to fold up against bar 18 so that the entire frame 10 assumes its stick-like form illustrated in FIG. 3. One leg 22 is shown partially unfolded.

Figure 4:
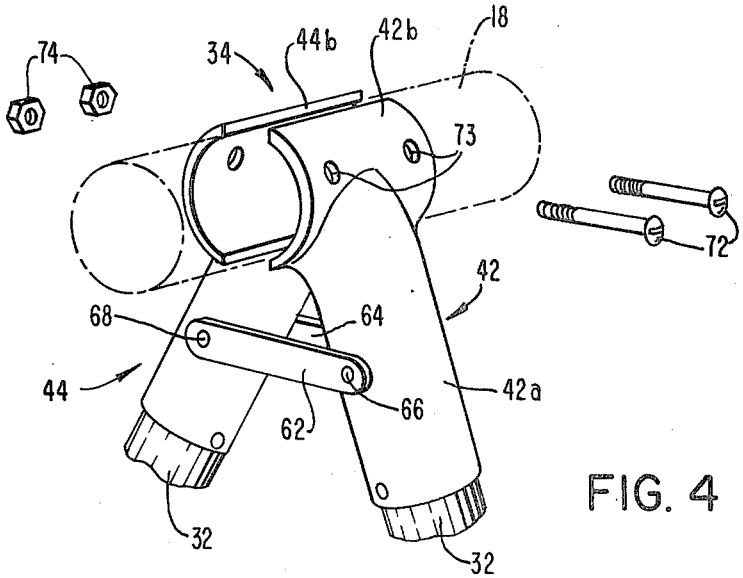
FIG. 4 is a fragmentary perspective view showing the foldable center legs used in the FIG. 1 gym.

Turning now to FIG. 4, in the event that an auxiliary pair of legs 32 are used as indicated in dotted lines in FIG. 1, the clamp 34 used to connect those legs to the horizontal bar has a somewhat different construction from the pivot joints at the ends of the play gym. More particularly, the same two joint sections 42 and 44 are employed. However, these are pivotally connected together with a pair of straps, 62 and 64.

One end of each strap is connected to opposite sides of sleeve 42*a* by rivet 66 passing through the straps, the sleeve 42*a* and the leg 32 therein. Similar rivets 68 are used to pivotally connect the opposite ends of those straps to sleeve 44*a* and the leg 32 therein. Thus when the legs 32 are spread apart when attaching the free end of the horizontal brace 35 to leg 32, the shells 42*b* and 44*b* form clam shells which grip the opposite sides of horizontal bar 18 as described above to further strengthen the play gym frame. Here also for added safety, one or more customer-installed bolts 72 can be slid through suitable openings 73 in the shells 42*b* and 44*b* and through opposite sides of bar 18, threaded nuts 74 being turned down onto the ends of the bolts 72. For added strength, straps such as the one shown in dotted lines at 75 in FIG. 4 can be positioned over the shells 42*b*, 44*b* prior to insertion. Alternatively, ears such as ear 57 (FIG. 2A) can be found on shells 42*b* and 44*b* to physically lock the shells together. As with the other legs, when it is desired to store the play gym, one end of the horizontal brace 35 can be detached from its adjacent leg and the legs folded together. This releases the clamp 34 from bar 28 and permits the auxiliary leg assembly to folded into stick form for compact storage.

In some cases it may be desirable to have the legs 22 or 32 removable from the joints. In this event, the joint sockets can be extended all around the legs forming tubular sockets into which the legs project. If desired for added safety, suitable customer installed bolts (not shown) can be passed through openings provided in the sockets and legs.

Figure 12:
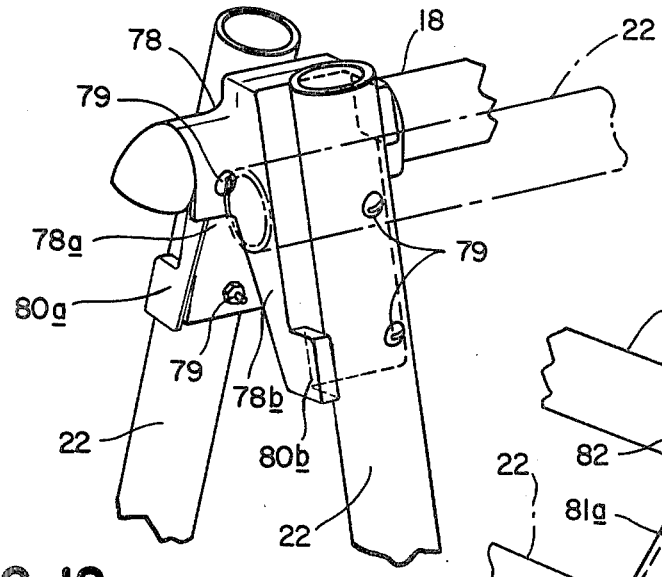
FIG. 12 is a similar view of another pivot embodiment for the FIG. 1 swing.
Figure 13:
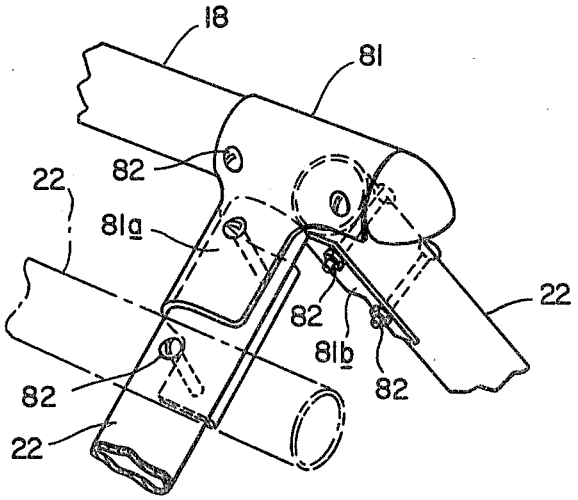
FIG. 13 is a similar view of still another pivot structure for the FIG. 1 swing.

FIGS. 11 to 13 depict different pivot joint embodiments for foldably interconnecting bar 18 and legs 22 of the FIG. 1 gym. In FIG. 11 the pivot joint comprises a single formed shell 76 having three lobes 76*a*, 76*b* and 76*c* shaped to receive and clamp the ends of bar 18 and legs 22 respectively. The bar and legs are secured to the shell by pairs of spaced-apart bolts 77 extending through the bar and legs and the adjacent stretches of shell 76. Removal of the bolts furthest away from the ends of the bar and legs permits those members to pivot together from their solid line positions to the positions indicated in dotted lines, the shell shape accommodating such movement.

The FIG. 12 arrangement includes a shell 78 which receives the end of bar 18. The shell includes skirts 78*a* and 78*b* extending down on opposite side of the bar. Legs 22 are connected to the shell by bolts 79. One bolt extends through both sides of the shell and bar 18 as well as through legs 22. Two additional bolts secure the legs 22 to the shell skirts 78*a* and 78*b* respectively. Detents 80*a* and 80*b* formed on each side of shell 78 limit the excursions of the legs 22 relative to the shell when the lowermost two bolts 79 are removed. Here also the legs can be moved from their solid line positions wherein they support bar 18 to a position wherein they lie against the bar as indicated in dotted lines in that figure.

FIG. 13 shows another joint version including a shell 81 extending around bar 18 and having depending sockets 81*a* and 81*b* for receiving the legs 22. A pair of bolts 82 secure the shell to the bar. Similar pairs of bolts retain the legs in the sockets. Removal of the uppermost bolts on the legs permits the legs to pivot between their solid and dotted line positions.

Figure 5:
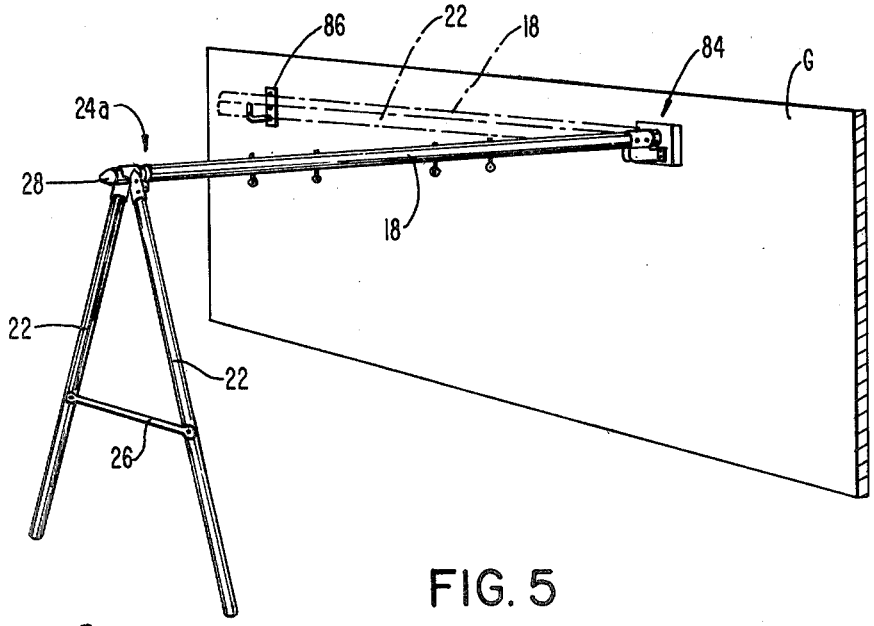
FIG. 5 is a view similar to FIG. 1 illustrating a modified play gym for use in small areas.

In FIG. 5, the play gym frame 10 shown in FIG. 1 has been modified to eliminate pivot joint 24*b* and associated legs 22. Instead, the end of horizontal bar 18 is suspended from a vertical support G, such as the side of a garage or house, by a single-axis pivot joint indicated generally at 84. Pivot joint 84 permits the play gym frame to extend out away from the surface G when the play gym is being used as indicated in solid lines in FIG. 5. It also permits the gym to be swung flush against the surface G when the legs 22 are folded up as aforesaid to assume a stick form as shown in dotted lines in FIG. 5. A suitable U-shaped bracket 86 secured to the side of support G may be provided to support the free ends of the folded play gym components.

Figure 6:
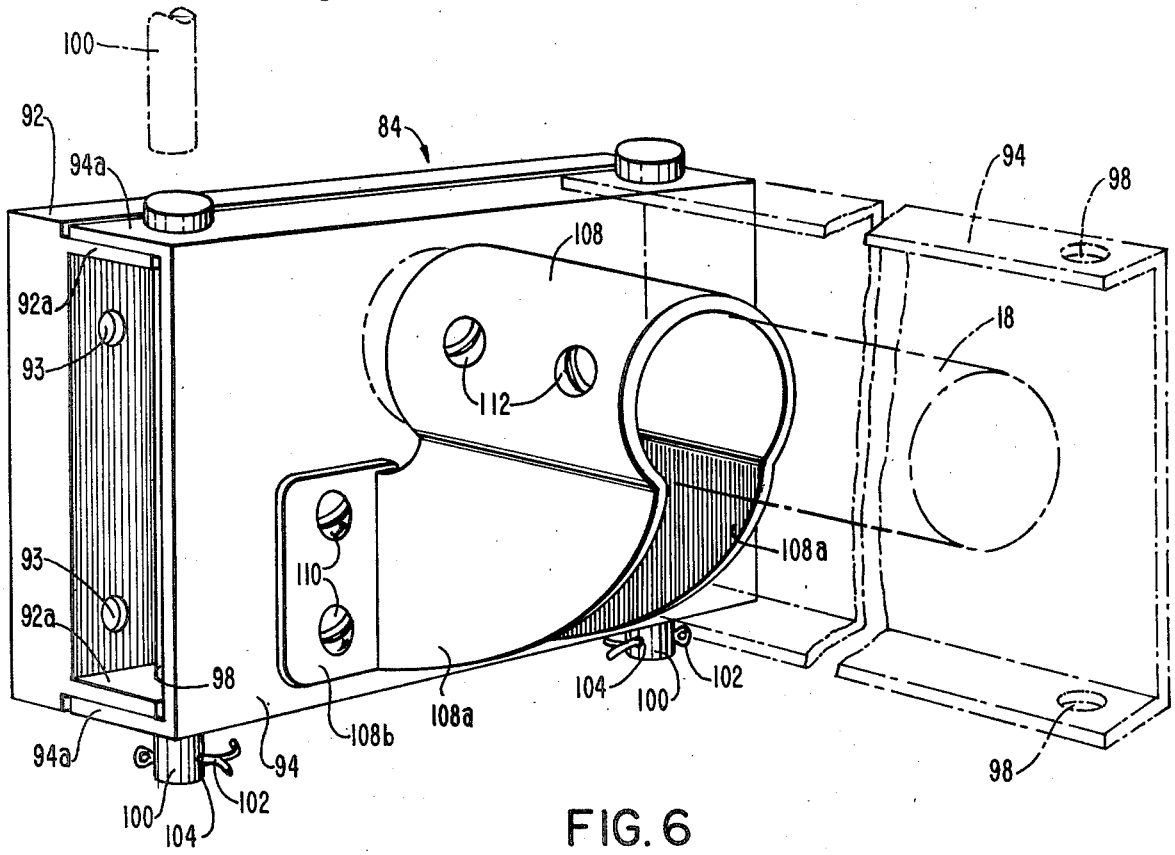
FIG. 6 is a fragmentary perspective view showing a portion of the FIG. 5 gym in greater detail.

Referring now to FIG. 6, pivot joint 84 comprises a generally rectangular metal bracket 92 which can be secured to support G by suitable nails or screws (not shown) passing through openings 93 in the bracket end extending into the support. Bracket 92 has a pair of parallel upper and lower flanges 92*a* extending out from its upper and lower edges.

A generally rectangular metal channel 94 having about the same dimensions as bracket 92 is engaged to the bracket. Channel 94 has a pair of upper and lower inwardly extending flanges 94*a* which engage over flanges 92*a*. Vertical in-line openings 98 are formed through flanges 92*a* and 94*a* at each end of the joint 84 to accommodate a pair of pins 100. These pins are dropped down through the openings 98 to lock the channel 94 to bracket 92. Also, if desired, cotter pins 102 can be inserted through small horizontal openings 104 at the bottoms of pins 100 to prevent the pins from being pulled out inadvertently from their openings 98.

Secured to the front face of channel 94 is a strap 108 for retaining the end of horizontal bar 18. Strap 108 is generally cylindrical and has a diameter that is slightly larger than that of bar 18 so that it can snugly engage around the end of the bar. Further, the strap has a pair of legs 108*a* extending down at each side of the strap and each of these legs terminates in a laterally extending tab 108*b* which lies flush against the front face of channel 94. Screws 110 extend through openings in each tab 108*b* and registering openings in the front face of channel 94, with suitable nuts (not shown) being turned down onto the ends of screws inside the channel to securely anchor the strap 108 to channel 94. Additional screws 111 extend through appropriate openings in strap 108 and are turned down into registering openings in bar 18 to ensure that the bar does not pull away from the pivot joint.

When both pins 100 are in place, the end of the horizontal bar 18 is supported so that the play gym extends out at right angles to surface G whereby children can use the various rides suspended from the play gym frame 10. When it is desired to use the space occupied by the play gym for other purposes, one end of the brace 26 is detached and the legs 22 are folded together and up against bar 18. Also the right-hand pin 100 in joint 84 is removed from its openings 98. This permits the channel 94 to pivot about the other pin 100 so that the legs 22 and bar 18 can be swung against surface G as shown in FIG. 5 with the free ends of those elements being supported by bracket 86. Of course if it is desired to fold the legs and bar 18 against surface G in the opposite direction, then the other pin 100 is removed. Finally, removal of the play gym frame 10 from surface G is simply a matter of extracting both pins 100 from their openings 98. This permits the channel 94 to be removed from bracket 92 so that the play gym frame can be stored indoors or transported elsewhere.

FIGS. 9 and 20 depict modified pivot joints for use on the FIG. 5 gym. The joint shown in FIG. 9 comprises a plate 123 bolted to support G. A laterally extending shoulder 124 extends out from the top edge of the plate with depending struts **124*a* connected to the plate. The end of bar 18 is secured to the shoulder by a pair of spaced bolts 125. Removal of the innermost bolts permits the bar to swing from its dotted line position to its solid line position against support G. An upstanding ear 124*b* at the end of shoulder 124 stops the outward swinging of bar 28 when the bar is perpendicular to plate 123**.

The joint shown in FIG. 10 includes a tubular gudgeon 126 secured to support G. The end **18*a* of bar 18 is wrapped about and bolted to a pintle 127 pivotally supported by the gudgeon. This permits bar 18** to be swung between its solid and dotted line positions.

Figure 7:
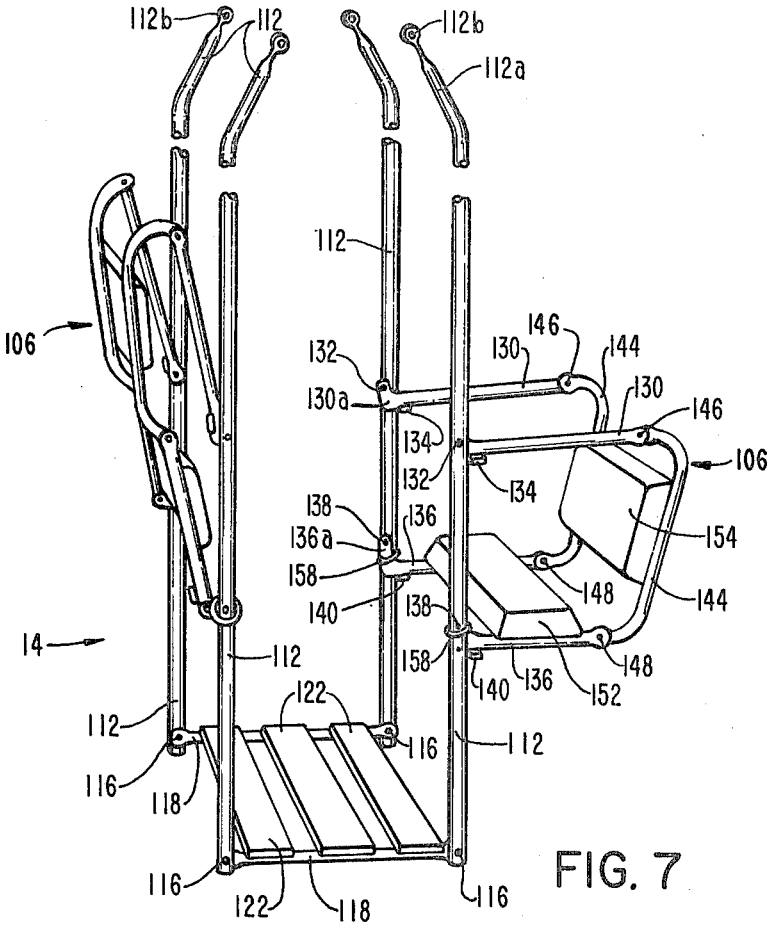
FIG. 7 is a perspective view showing the foldable swing in FIG. 1 in somewhat greater detail.
Figure 8:
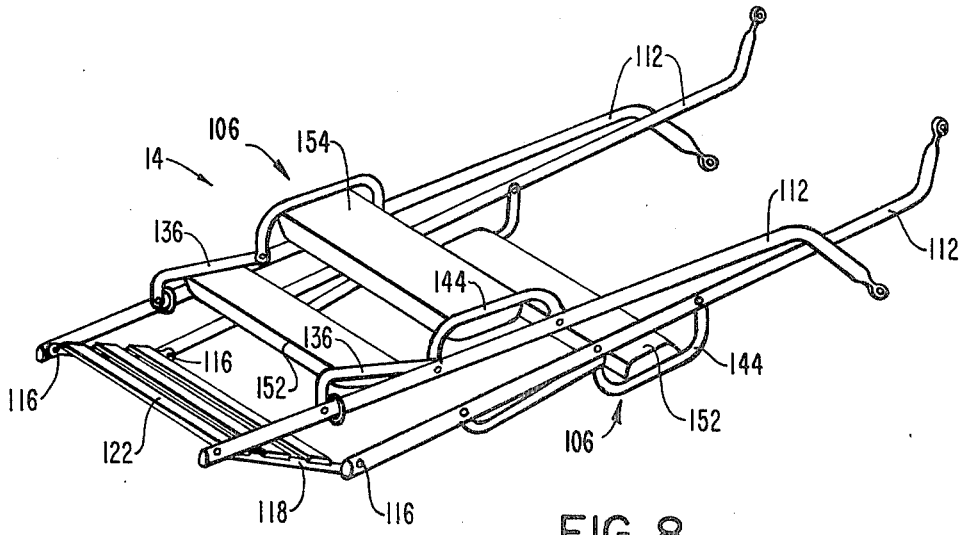
FIG. 8 is a similar view showing the swing in its folded condition.

Turning now to FIGS. 7 and 8, swing 14 is also foldable so that it can be stored or shipped in the flattened condition illustrated in FIG. 8. More particularly, each swing seat assembly 106 can be moved from an operative position illustrated at the right hand side of FIG. 7 in which it can support an occupant, to a raised, generally vertical, folded position wherein its elements repose against the vertical swing frame. The assembly 106 is shown partially folded at the left side of FIG. 7. This allows the swing as a whole to be folded flat as shown in FIG. 8 when it is removed from the gym frame 10 (FIG. 1).

Swing 14 comprises four identical, vertical frame members 112. The upper end **112*a* of each frame member 112 is bent at an angle and terminates in an eye 112*b*. These frame members are pivotally connected via these eyes to brackets 114 clamped to bar 18 by suitable bolts 116, all as shown in FIG. 1**.

The lower ends of the front-most pair of frame members 112 are connected by pivots 116 to the opposite ends of a short horizontal frame member 118. A similar horizontal member 118 is pivotally connected to the lower ends of the rear-most pair of frame members 112. A set of spaced-apart, parallel slats 122 are secured to frame members 118 and form the floor of the swing. Thus when a child stands on the slats 122 and rocks back and forth, the frame members will swing about their pivots at 116 and **112*b* with slats 122** remaining in a generally horizontal plane as is customary with such swings.

The seat assemblies 106 are substantially identical. Therefore we will describe only the right hand assembly in detail. It comprises a pair of parallel upper frame members 130. The left hand end of each frame member 130 is formed with an upwardly extending ear **130*a* which is connected to a vertical frame member 112 by a pivot 132. Also, a detent 134 extends laterally from each frame member 130 adjacent to its ear 130*a* and the detents 134 bear against the adjacent frame members 112 to stop the seat frame members 130** when they are disposed horizontally.

A pair of spaced-apart parallel lower seat frame members 136 are also pivoted to swing frame members 112. For this, they are provided at their left hand ends with upwardly extending cars **136*a*, each of which is connected by a pivot 138 to the adjacent frame member 112. These frame members 136 also have laterally extending detents 140 adjacent their ears 136*a* which engage frame members 12 to stop frame members 136** when they are extending horizontally.

A bowed frame member 144 has its opposite ends positioned against the free ends of members 130 and 136 at the front of the swing and is pivotally connected to the ends of those members by pivots 146 and 148. An identical bowed frame member 144 is pivotally connected to the free ends of members 130 and 136 at the rear of the swing. A rigid seat member 152 reposes on frames 136 and is secured at its opposite ends to those members. Likewise a backrest member 154 is secured to the bridging portions of frame members 144 to form the finished seat.

This seat assembly construction provides firm support for the occupant of the swing, yet permits the seat assemblies 106 to be folded upwardly so that they lie flush against frames 112 when it is desired to store the swing.

Suitable lock rings 158 may be engaged around frames 112 so that they can drop down around ears **136*a* to prevent the seat assemblies 106 from being lifted up inadvertently. In other words, both rings 158 on each seat assembly must be slid up away from ears 136*a*** simultaneously in order to fold the seat assembly.

Figure 14:
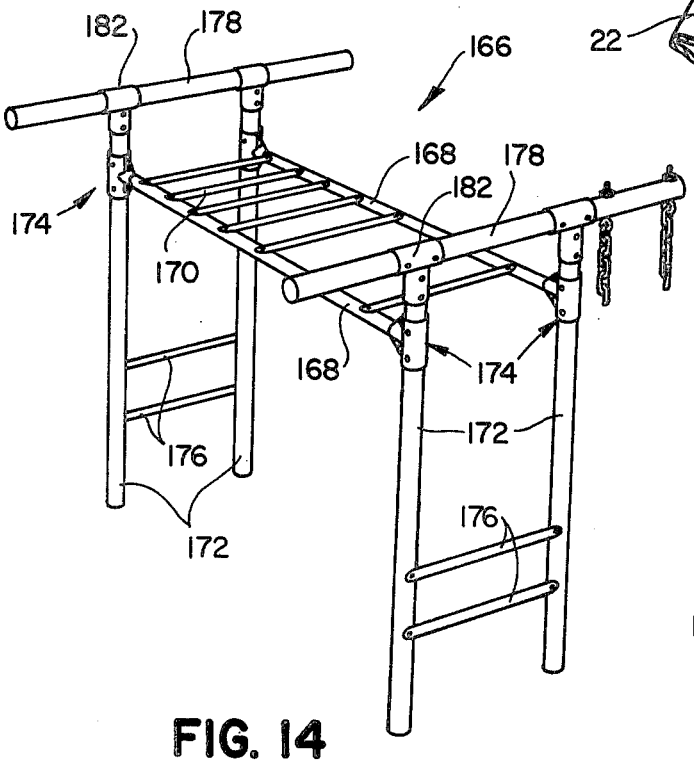
FIG. 14 is a perspective view of a modified folding play gym.
Figure 15:
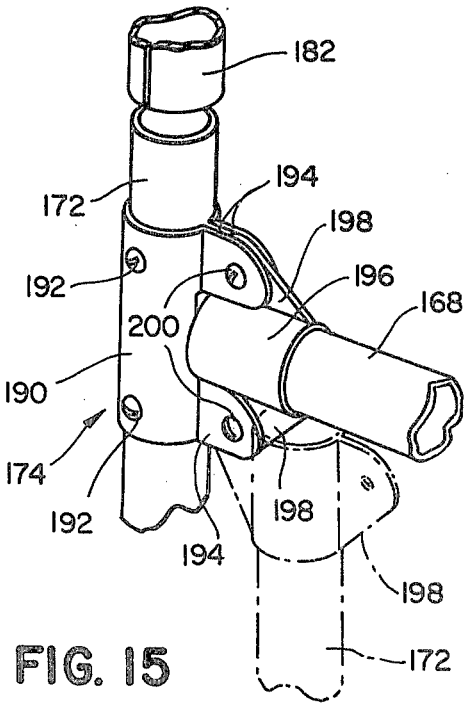
FIG. 15 is a view similar to FIG. 6 of the pivot structure used on the FIG. 14 swing embodiment.

Referring now to FIGS. 14 and 15, the folding principles disclosed here can also be incorporated into a T-shaped play gym generally at 166. This gym comprises a pair of spaced-apart horizontal bars 168 that form the stiles of a traversing ladder. Rungs 170 are connected between the two bars. The bars are supported at their ends by identical legs 172 connected to the bars near their upper ends by pivot joints 174. Horizontal braces 176 are connected between the legs at each end of the gym. The upper ends of the legs at each end are also interconnected by a large diameter pipe 178 whose ends extend beyond the legs forming a T-shape. Swing supporting chains 180 may be suspended from the ends of these pipes as indicated. The connection between each pipe 178 and its legs is provided by a pair of T-shaped sockets 182 each of which is slid onto pipe 178 and receives the end of a leg 172.

As best seen in FIG. 15, each pivot structure 174 includes a cylindrical split sleeve 190 slid onto leg 172 and retained there by bolts 192. The sleeve has spaced pairs of ears 194 formed at the edges of the split which project laterally. A second sleeve 196 engages over the end of stile 168. This sleeve has wings 198 that project out at the top and bottom of the sleeve and extend between the ears 194 respectively. Bolts 200 extend through registering openings in the wings and ears to retain those elements in the solid line position shown in FIG. 15. Removal of the uppermost bolt 200 permits the stile 168 to fold against the adjacent leg 172 as shown in dotted lines in FIG. 15.

We have seen from the foregoing that the present gym construction provides strong support for the various rides suspended from the gym frame. Yet it permits the gym frame and swing 14 to be quickly and easily folded up for storage in a minimum amount of space. Further, the gym can be shipped in a relatively small package and can be erected very easily since most of its major components are already interconnected at the factory. These same features permit ready folding of the gym in the event that it is desired to store the equipment or move it to a new location. Yet with all of these advantages, the gym is not appreciably more expensive than prior conventional gyms in use today.

It will thus be seen that the objects set forth above, among those made apparent from the preceding description are efficiently attained, and since certain changes may be made in the above constructions without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention herein described.

I claim:

1. A play gym comprising

A. a horizontal bar,

B. a leg assembly for supporting at least one end of the bar, said assembly including 1. a pair of relatively long tubular legs,
2. a three-axis pivot joint connecting the upper ends of said legs to each other and to the horizontal bar, said pivot joint including a pair of sockets for receiving the ends of said legs, connecting means extending between said sockets, a pair of spaced-apart pivots linking said connecting means and said sockets, the axes of said pivots being parallel to one another and perpendicular to the axes of said legs, means for pivotally connecting said connecting means to the bar, the pivotal axis of said pivotal connecting means being perpendicular to the bar and perpendicular to the axes of said pivots so that the legs can be swung together so as to lie parallel to one another and both said legs can be swung against said bar so that they lie substantially parallel to the bar,
3. arcuate shells integral with the upper ends of said sockets, the axes of said shells being oriented at right angles to the axes of said sockets, said shells being arranged and adapted to clamp against opposite sides of said bar when the legs are maintained in their spread-apart condition and to disengage from said bar when said legs are swung parallel to one another so as to permit said legs to be folded against the bar, and
4. means for releasably maintaining the legs in a spread-apart condition at right angles to the bar so that they support said end of the bar above the ground, and C. means for supporting the opposite end of the bar above the ground.

2. A play gym as defined in claim 1 further comprises a second similar leg assembly.

3. The play gym defined in claim 1 and further including

A. means defining aligned openings in said shells and said bar,

B. an end cap engaged on the end of said bar, said end cap having an eye extending into the end of the bar in alignment with said openings, and C. a fastener extending through said openings and said eye for simultaneously retaining the cap on the end of the bar and securing the shells to the bar.

4. The play gym defined in claim 1 and further including a glide swing pivotally suspended from the bar, said swing comprising A. laterally spaced pair of depending hangers, B. a platform pivotally secured to the lower ends of the hangers, and C. a pair of oppositely-disposed seat assemblies pivotally connected to the hangers above the platform, each said seat assembly comprising laterally spaced pairs of seat frame members, means for pivotally connected ends of the seat frame members to the laterally spaced pairs of hangers, a seat extending between said pairs of seat frame members for supporting a rider, means for limiting the pivotal movement of said seat frame members relative to said hangers so that said seat frame members cannot extend below their pivotal connections to the hangers whereby each seat assembly can be moved from an active position wherein its seat lies in horizontal plane to a folded position wherein its seat lies essentially in a vertical plane parallel to the hangers.

5. The play gym defined in claim 1 wherein the means for supporting the opposite end of the bar comprise a single axis pivot joint which permits said bar to be swung in a generally horizontal plane.

6. The play gym defined in claim 5 wherein the single axis pivot joint includes A. a bracket for securement to a support, B. a plate for engagement to the bracket, C. a pair of laterally spaced-apart removable hinges connected between the plate and the bracket so that when one or the other of the hinges is removed, the plate can swing from a position flush against the bracket to a position wherein it extends out perpendicular to the bracket at one or the other end thereof, and D. a socket projecting out from the plate, the axis of said socket being in a generally horizontal plane and arranged to snugly receive the opposite end of said bar.

7. The play gym defined in claim 6 wherein each said hinge comprises a pin extending loosely through overlapping horizontal portions of said plate and bracket.

8. The play gym defined in claim 5 wherein the single axis pivot joint includes:

A. a stub member,

B. means for securing said stub member to the opposite end of said bar so that said stub member is perpendicular to said bar, C. a bracket for securement to a support, said bracket having means for swingably receiving the opposite ends of said stub member, and D. a means for defining an aperture between said receiving means for accommodating movements of said opposite end of the bar when said bar is swung in a horizontal plane.

9. The play gym defined in claim 5 wherein the single axis pivot joint comprises:

A. a bracket for securement to a support, said bracket having a generally horizontal shelf, and B. means for pivotally connecting the opposite end of said bar to said shelf so as to permit said bar to swing in a horizontal plane.

10. The play gym defined in claim 1 and further including

A. an additional pair of legs, and

B. means for connecting the upper ends of said additional legs to said bar, said connecting means including a pair of sockets for receiving the upper ends of said additional legs, means for pivotally connecting the sockets to one another so that the additional legs can swing from a first position wherein they lie essentially parallel to one another to a spread-apart position wherein they form an inverted V, a pair of arcuate shells integral with the upper ends of said second pair of sockets, the axes of said shells being perpendicular to the axes of said sockets and said shells being arranged to clamp around opposite sides of said bar when the additional legs are in their spread-apart position, and means releasably connected between said additional legs for maintaining these legs in their spread-apart position.

11. A play gym comprising:

A. horizontal bar,

B. a leg assembly supporting at least one end of the bar, said assembly including 1. a pair of relatively long tubular legs,
2. a three-axis pivot joint connecting the upper ends of said legs to each other and to the horizontal bar, said pivot joint including a pair of sockets for receiving the ends of said legs, connecting means extending between said sockets, said sockets and connecting means together forming a unitary shell at the end of the horizontal bar, a pair of spaced-apart pivots linking said connecting means and said sockets, the axes of said pivots being parallel to one another and perpendicular to the axes of said legs, means for pivotally connecting said connecting means to the bar, the pivotal axes of the pivotal connecting means being perpendicular to the bar and perpendicular to the axes of said pivots so that the legs can be swung together so as to lie parallel to one another and so that both said legs can be swung against said bar whereby they lie substantially parallel to the bar, and
3. means for releasably maintaining the legs in a spread-apart condition at right angles to the bar so that they support the end of the bar above the ground, and C. means for supporting the opposite end of the bar above the ground.

12. A play gym comprising:

A. a horizontal bar,

B. a leg assembly supporting at least one end of the bar, said assembly including 1. a pair of relatively long tubular legs,
2. a pivot joint engaged over one end of the horizontal bar said pivot joint having a pair of diverging arms extending perpendicular to the axis of the horizontal bar,
3. means for connecting the pivot joint to said one end of the horizontal bar,
4. means for pivotally connecting one end of each of said legs to a different one of said arms, said pivotal connecting means being parallel to each other and also perpendicular to the axis of the horizontal bar so that said legs can be swung from a first position wherein they diverge and extend perpendicular to the horizontal bar to a second position wherein they lie substantially parallel to the axis of the horizontal bar, and
5. means for releasably maintaining the legs in their first position so that they support said end of the bar above the ground, C. means for supporting the opposite ends of the bar above the ground.

* * * * *

UNITED STATES PATENT AND TRADEMARK OFFICE

CERTIFICATE OF CORRECTION

PATENT NO. : 4,190,283

DATED : February 26, 1980

INVENTOR(S) : Raymond W. Boucher

It is certified that error appears in the above-identified patent and that said Letters Patent are hereby corrected as shown below:

Col. 1, line 16, change "have, of course, have" to --have, of course,--.

Col. 1, line 22, change "horizntal" to --horizontal--.

Col. 3, line 68, change "is" to --as--.

Col. 4, line 53, change "bar 28" to --bar 18--.

Col. 4, line 63, change "bar 28" to --bar 18--.

Col. 4, line 65, change "bar 28" to --bar 18--.

Col. 5, line 5, change "extends" to --extend--.

Col. 5, line 15, change "bar 28" to --bar 18--.

Col. 5, line 51, change "bar 28" to --bar 18--.

Col. 5, line 52, change "to folded" to --to be folded--.

Col. 6, line 7, change "side" to --sides--.

Col. 7, line 28, change "20" to --10--.

Col. 7, line 39, change "bar 28" to --bar 18--.

UNITED STATES PATENT AND TRADEMARK OFFICE

CERTIFICATE OF CORRECTION

PATENT NO. : 4,190,283

DATED : February 26, 1980

INVENTOR(S) : Raymond W. Boucher

It is certified that error appears in the above-identified patent and that said Letters Patent are hereby corrected as shown below:

Col. 8, Line 21, "cars" should be --ears--.

Signed and Sealed this

*Fifteenth* Day of *September 1981*

[SEAL]

*Attest:*

GERALD J. MOSSINGHOFF

*Attesting Officer* *Commissioner of Patents and Trademarks*